US008136320B2

(12) United States Patent
Keene

(10) Patent No.: US 8,136,320 B2
(45) Date of Patent: Mar. 20, 2012

(54) SPACER ASSEMBLY FOR PREVENTING AN ACOUSTIC SHORT CIRCUIT IN A BUILDING

(75) Inventor: James R. Keene, Pepper Pike, OH (US)

(73) Assignee: Keene Building Products Co., Inc., Mayfield Heights, OH (US)

( * ) Notice: Subject to any disclaimer, the term of this patent is extended or adjusted under 35 U.S.C. 154(b) by 345 days.

(21) Appl. No.: 12/152,359

(22) Filed: May 15, 2008

(65) Prior Publication Data

US 2009/0283658 A1 Nov. 19, 2009

(51) Int. Cl.
*E04B 2/30* (2006.01)

(52) U.S. Cl. ..... 52/489.1; 52/144; 52/511; 52/712

(58) Field of Classification Search ..... 52/144, 52/145, 403.1, 489.1, 506.06, 480, 511, 512
See application file for complete search history.

(56) References Cited

U.S. PATENT DOCUMENTS

| | | | | |
|---|---|---|---|---|
| 2,115,238 | A * | 4/1938 | Stevens | 52/402 |
| 3,067,323 | A * | 12/1962 | Kember | 362/150 |
| 5,718,095 | A * | 2/1998 | Kemeny | 52/698 |
| 6,055,785 | A * | 5/2000 | Counihan | 52/403.1 |
| 6,070,381 | A * | 6/2000 | Blumer | 52/403.1 |
| 6,115,981 | A * | 9/2000 | Counihan | 52/403.1 |
| 7,478,787 | B2 * | 1/2009 | Bankston et al. | 248/343 |

* cited by examiner

*Primary Examiner* — Brian Glessner
*Assistant Examiner* — Adam Barlow
(74) *Attorney, Agent, or Firm* — Renner, Otto, Boisselle & Sklar, LLP

(57) ABSTRACT

A spacer assembly adapted to prevent the formation of acoustical short circuits in a building ceiling, floor and/or wall assembly. The spacer assembly includes a support member and is adapted for spacing and supporting a finished interior building element in acoustic isolation with respect to a structural member.

23 Claims, 8 Drawing Sheets

SPACER ASSEMBLY FOR PREVENTING AN ACOUSTIC SHORT CIRCUIT IN A BUILDING

FIELD OF THE INVENTION

The present invention relates to building constructions and acoustic control therein. More specifically, the present invention relates to a spacer assembly adapted to prevent an acoustic short circuit in a building ceiling, floor or wall assembly.

BRIEF DISCUSSION OF THE RELATED ART

Acoustic short circuits are a commonly-encountered problem in buildings resulting from faulty construction practices. Short circuiting refers to the situation where building structural elements become linked, often through a fastener (e.g., a screw), in such a manner that vibrational energy, particularly sound energy, affecting one of the structural elements is transmitted to the linked structure. Vibrations are typically manifested as noise, especially low-frequency noise. The effects of acoustic short circuiting are extremely noticeable and objectionable in multi-unit buildings, such as condominiums, apartment buildings, and the like where people are present near others or near electrical or mechanical equipment. For example, if two units of the multi-unit building, such as a first dwelling area and a second dwelling area located immediately above the first dwelling area, are short circuited, vibrations generated in the first area are transmitted to the second area as noise or other sounds, thereby disturbing the enjoyment of the second area.

Acoustic short circuiting often occurs in flooring assemblies. As is known, a flooring assembly typically includes a plurality of horizontally extending, parallel placed joists that provide support for the building itself and for an intermediate substrate for other features of the flooring assembly. The joists provide a structural substrate for installation of finished flooring elements, i.e., a subfloor, finished flooring and related components, to thereby complete the flooring of a first building unit and/or room. The joists also provide a substrate for installation of ceiling elements to thereby complete the ceiling of a unit and/or room disposed below the first unit and/or room. With regard to the ceiling elements, one or more support elements are fastened to the bottoms of the joists. The support elements may include channels and are typically elongate, horizontally extending and placed on the bottoms of the joists perpendicularly thereto. The supporting elements provide a supporting structure or substrate for installation of finished ceiling or wall elements, such as gypsum board, also known as dry wall. In practice, fasteners, typically screws, are passed through the gypsum board into the supporting elements, thereby completing installation of the ceiling, flooring or wall assemblies.

By error, the fasteners used to secure gypsum board to the supporting elements are often driven into the joists. This error physically couples the gypsum board and the supporting element to the joists and results in the creation of an acoustic short circuit that will allow vibrational energy present in the joists to be transmitted to the gypsum board and, ultimately to the unit or room below as sound. Similarly, vibrations can be transmitted horizontally or vertically upward. The transmission of vibrational energy in the form of vibrations or sound can lead to significant discomfort. For example, if individuals reside in a certain unit of a multi-unit dwelling structure that is acoustically short circuited to a second unit through the ceiling, floor or wall, the noise they generate will be readily observable by individuals in the second unit, likely to their displeasure. For contractors and developers, this can also cause building code violations since the national code requires that certain levels of noise control between room units of a building be achieved and maintained.

BRIEF SUMMARY OF THE INVENTION

In one exemplar aspect, the present invention is directed to a spacer assembly for preventing the formation of an acoustical coupling or short circuit between rooms or units through a ceiling, floor or wall assembly having at least one structural member, at least one finished interior element, and at least one support element that includes a U-shaped channel, the support element serving to space the finished interior element from the structural members to achieve acoustic isolation of the structural and finished elements. The spacer assembly generally includes a J-shaped spacer that resists penetration by fasteners and an engagement means adapted for enabling the U-shaped channel support to be operatively associated with and supported by the J-shaped spacer and a structural member engagement means adapted for enabling the spacer assembly to be connected to the structural member.

In another exemplar aspect, the present invention is directed to a building construction having a ceiling, floor or wall assembly that displays improved acoustic characteristics. The assembly generally includes at least one structural member; at least one finished interior element; at least one support element including a generally U-shaped channel disposed between the finished interior element and the structural member; and a penetration resistant spacer disposed at least partially between the channel and the finished interior element. The spacer generally includes a support element engaging means for retaining the support element with respect to the spacer and a structural member engagement means engaging the structural member. The spacer preferably has a hardness suitable for preventing a fastener holding the finished interior element from contacting the structural member.

In yet another exemplar aspect, the present invention is directed to a spacer for preventing the formation of an acoustical short circuit in a building construction ceiling, floor or wall assembly having at least one structural member, at least one finished interior element, and at least one supporting element having a generally: U-shaped channel for spacing the finished interior element from the structural member and preventing fasteners retaining the finished interior element from engaging the structural member. The spacer generally includes an engagement means adapted for enabling the supporting element to be engaged and supported by the spacer; a structural member engagement means adapted for enabling the spacer to be connected to the structural member; and a fastener blocking means adapted for preventing a fastener from passing therethrough, and wherein the fastener blocking means is adapted to be positioned between the structural member and the channel in the supporting element. The fastener blocking means of the spacer is preferably of a dimension suitable for preventing a fastener extending upward from the finished ceiling element from contacting the structural member.

BRIEF DESCRIPTION OF THE FIGURES

The above and other features and a more thorough understanding of the present invention may be achieved by referring to the following description and claims, taken in conjunction with the accompanying drawings, wherein:

DETAILED DESCRIPTION OF THE INVENTION

Disclosed is a spacer assembly for preventing an acoustic short circuit in building assembly and uses thereof. Acoustic short circuiting is a commonly encountered problem in building assembly construction that frequently results from imprecise or incorrect installation techniques in the installation of ceiling, floor or wall assemblies. For example, acoustic short circuits are commonly created between a ceiling assembly and a joist structure to which such ceiling is secured. The bottoms of ceiling joists typically are fitted with elongate resilient supporting elements having generally U-shaped channels to which gypsum board for a ceiling is fastened. During installation, the fasteners are driven through the gypsum board and anchored into the supporting elements for securely suspending the gypsum board as a ceiling. The intention is for the fasteners to intersect the U-shaped channel and stop short of the structural member. However, due to human error or the use of fasteners of incorrect length (e.g., any length greater than 1"), the fasteners are often driven through the channel and into the joist located above the channel. If the fastener passes through the gypsum board and into the joist, an acoustic short circuit is created between these two elements and permits the transfer of vibrational energy (e.g., noise, especially low-frequency noise) therebetween. In multi-unit dwellings or offices, the short-circuited joists usually support flooring materials thereon that define a finished floor of an adjacent building unit space. Therefore, noise or vibrations generated in one space adjacent to the location of the acoustic short circuit are transmitted to a second building unit space or spaces which are also adjacent to said short circuit, often to the annoyance and discomfort of the individuals residing or working in the second unit space.

As will be more fully explained hereinafter, the spacer assembly of the present invention prevents the formation of such a short circuit by preventing fasteners from engaging the joists. The spacer is adapted to be associated with the channel in the supporting element and/or joist and suitably eliminates the fastening of the finished interior element directly to the structural element. First, by being disposed between the joist and the ceiling gypsum board, the spacer maintains a fixed distance therebetween. This distance is preferably of a dimension greater than that which could be spanned by the recommended fastener. Second, the spacer is preferably constructed of a material that is impenetrable to a fastener. Accordingly, by being disposed between the ceiling gypsum board and the joist, the spacer provides a physical barrier and prevents the fastener from passing into the joist. These and other aspects of the invention will be more fully described hereinafter.

Figure 1:
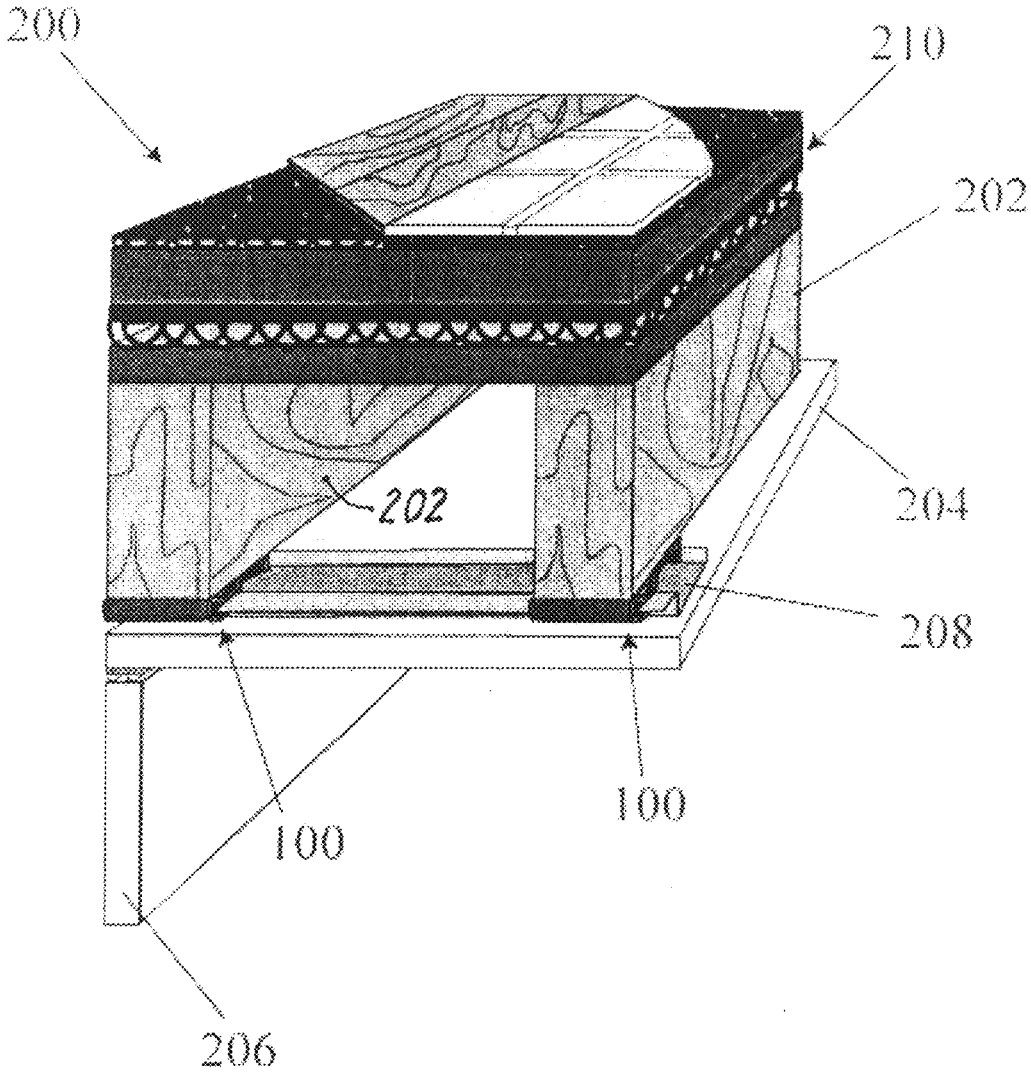
FIG. 1 is a perspective and partially cut away view of an example flooring assembly incorporating a pair of exemplary spacers, according to the present invention.
Figure 2:
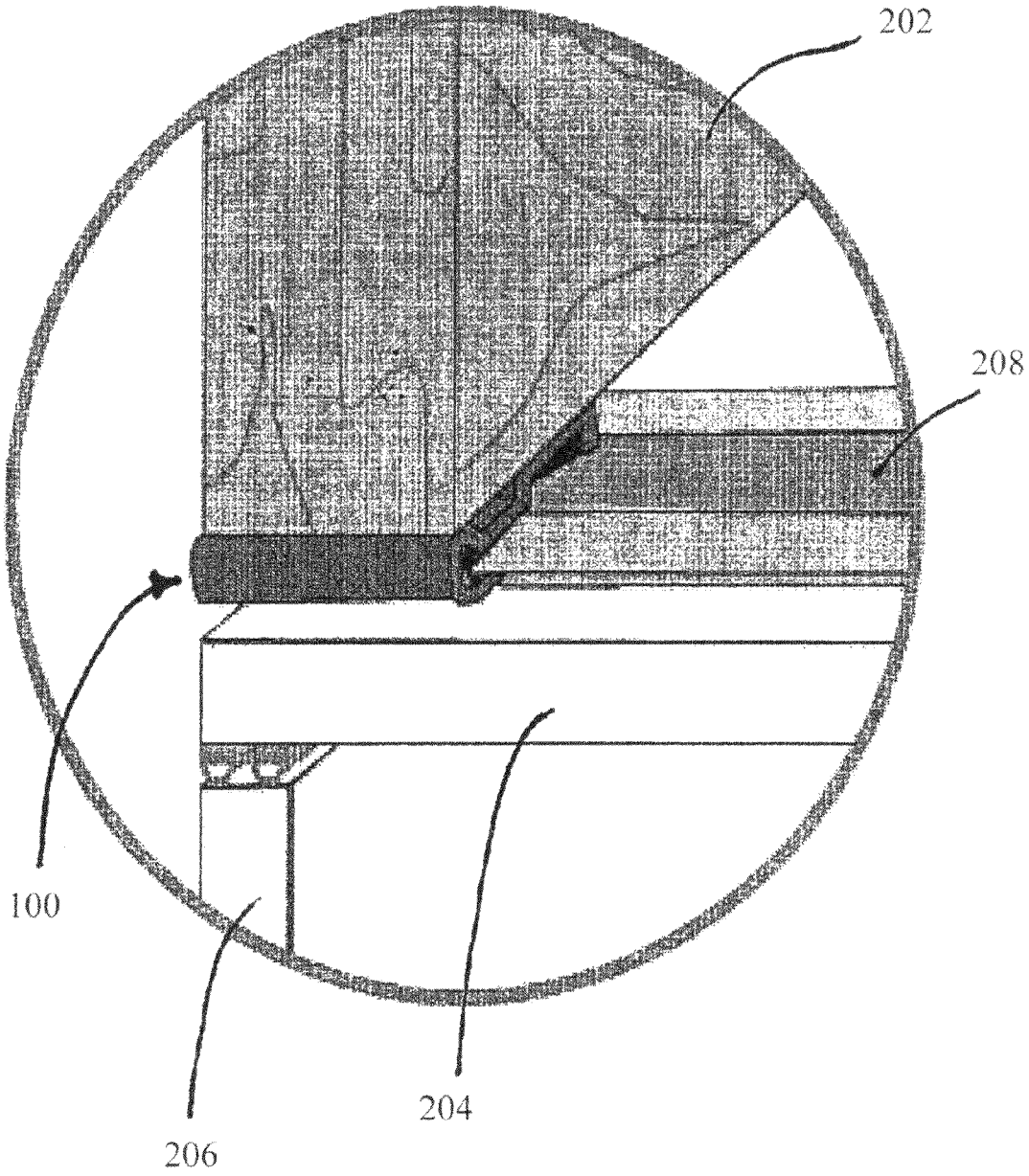
FIG. 2 is an enlarged view of FIG. 1, more particularly illustrating a portion of the flooring assembly where the spacer is positioned.

Turning now to FIGS. 1 and 2, illustrated is an example flooring assembly 200 to which the spacer 100 of the present invention is intended for use. The flooring assembly 200 generally consists of a plurality of structural supports or joists 202, a horizontal ceiling or wall member 204, one or more supporting elements 208, and a vertical wall element 206. The joists 202 are primary structural members to which other flooring and building elements are associated, and are typically elongate rectangular wooden beams disposed horizontally between vertical supporting wall members, and spaced apart and parallel to each other.

As best shown in FIG. 1, the joists 202 provide an intermediate structural member for supporting finished interior elements both above and below, i.e., a floor above and a ceiling below. In a multi-story construction, the joists 202 typically provide an intermediate structure between the ceiling of a first unit and/or room and the floor of a second unit and/or room disposed one story above the first unit. As can be seen, the joists 202 provide a substrate onto which finished flooring elements 210 are installed. Such finished flooring elements 210 may include such items as wood or similar suitable flooring materials, sound control materials, subfloor items, carpeting, tile, aesthetic elements, and the like.

The joists 202 suitably also provide a substrate for installation of various ceiling elements to bottom portions thereof. As also shown in FIGS. 1 and 2, the joists 202 provide support for ceiling elements such as sheets of gypsum board 204 along a bottom portion thereof. As is known, the gypsum board may in turn feature aesthetic elements and/or be modified to complete and customize the appearance of the ceiling.

Prior to the invention of this application, conventional installation of gypsum board to the bottom of structural joists typically included one or more elongate sheet metal, usually steel, support elements 208 having generally U-shaped channels therein. In the construction trades, the support elements 208 are commonly called "channels" and for the sake of convenience will be referred to as channels hereinafter. The channels 208 are disposed between the ceiling element 204 and perpendicular to the joists 202. The channels 208 are intended to improve the acoustic properties of flooring assemblies 200 by physically separating and acoustically decoupling the finished ceiling, i.e., the gypsum board 204, from the joists 202. By decoupling the gypsum board from the joists, the likelihood of creating an acoustic short circuit therebetween is reduced. However, as mentioned above, unintended installation errors frustrates the intent of using channels 208 when fasteners are driven completely through the channels 208 and into the joists 202. Fasteners passing through the channels into the joists create an acoustic short circuit that is prevented by the present invention.

Figure 6:
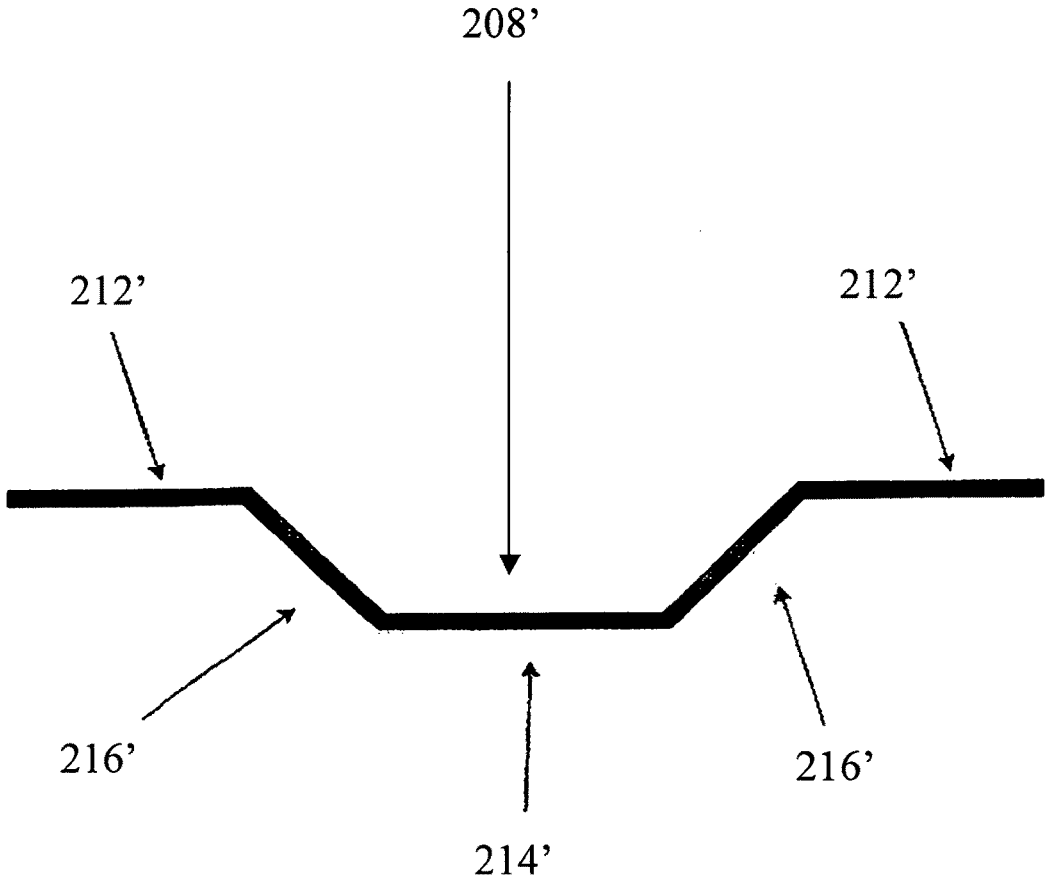
FIG. 6 is a cross sectional view of an exemplary channel to which the spacer of the present invention may be secured.

Channels 208 are typically provided in one of two configurations, a hat channel and a resilient channel. With reference to FIG. 6, a hat channel 208' is an elongate sheet metal or polymeric member adapted to be secured to bottom portions of joists 202 and the gypsum board 208 is fastened thereto. FIG. 6 presents a cross sectional view of a typical hat channel 208' that is characterized by a pair of flanges 212', a gypsum board fastening portion 214', and a pair of angular arms 216'. The gypsum board fastening portion 214' is preferably a planar portion defining a middle, lower portion of the channel 208'. The arms 216' extend angularly upward (at an approximately 45 degree angle) and away from opposite edges of the fastening portion 214'. The flanges 212', in turn, extend away from edges of the angular arms 216' and are substantially parallel to the fastening portion 214'. Because of the presence of the angular arms 216', the flanges 212' are disposed vertically offset and/or raised relative to the fastening portion 214'.

Prior to the invention of this application, during installation of the channel 208', the channel 208' is typically secured directly to bottom portions of the joists 202 with threaded fasteners, and then the gypsum board 204 is fastened to the channel 208'. More specifically, upper faces of the flanges 212' are positioned flush against bottom portions of the joists 202 and fasteners are passed through the flanges 212' and into the joists 202 to secure the channel 208' to the joists 202. In this configuration, the fastening portion 214' is spaced apart from the joist 202. Accordingly, gypsum board 204 is then positioned horizontally and flush against the channel 208' fastening portion 214', and fasteners are driven through the gypsum board 204 and into the fastening portion 214', thereby securing the gypsum board 204 to the channel 208' and, in turn, joist 202.

Figure 7:
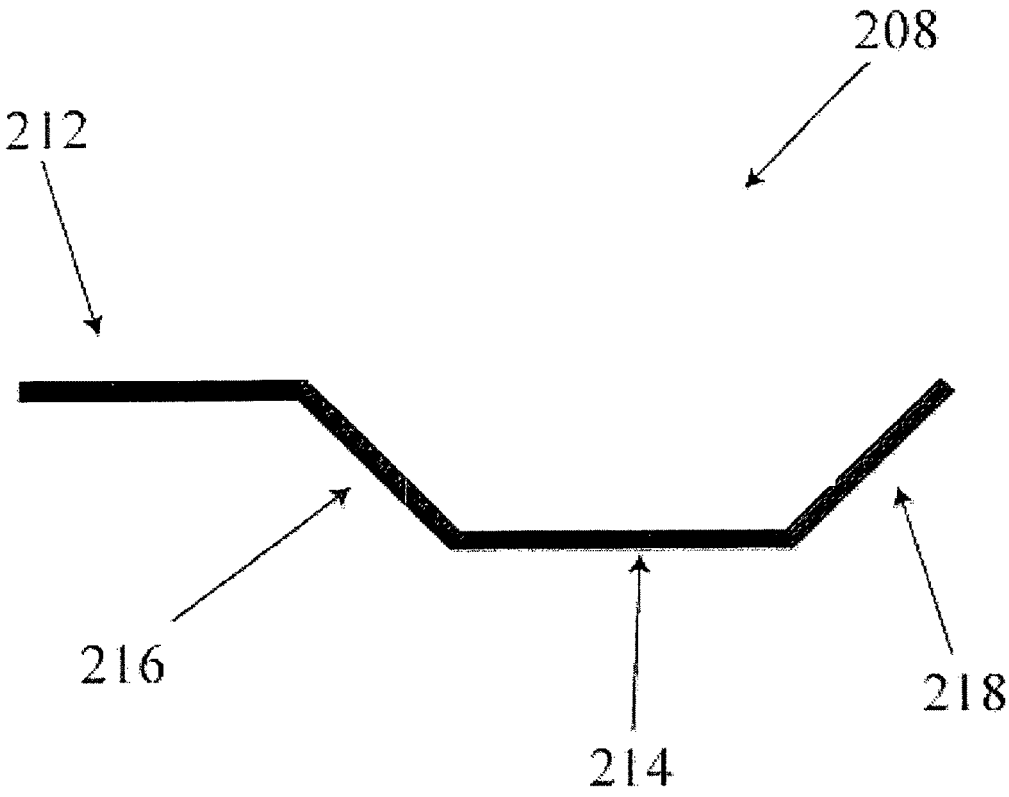
FIG. 7 is a cross sectional view of an alternate example channel to which the spacer of the present invention may be secured.

FIG. 7 illustrates an alternate channel 208 commonly referred to as a resilient channel 208. As evident from the Figure, a resilient channel 208 differs from a hat channel 208' in that the resilient channel 208 features a single flange 212, as opposed to the hat channel 208' that features a pair of flanges 212'. In installation, the resilient channel 208 flange 212 is brought flush against joist bottom portion and then a fastener is passed through the flange 212 into the joist 202, thereby securing the channel 208 to the joist 202. Thereafter, the gypsum board 204 is brought against the fastening portion 214 and fastened thereto. The installation of the resilient channel 208 results in an angular arm 218 remaining free and unfastened, thus resulting in the resiliency provided by the channel 208.

Figure 3:
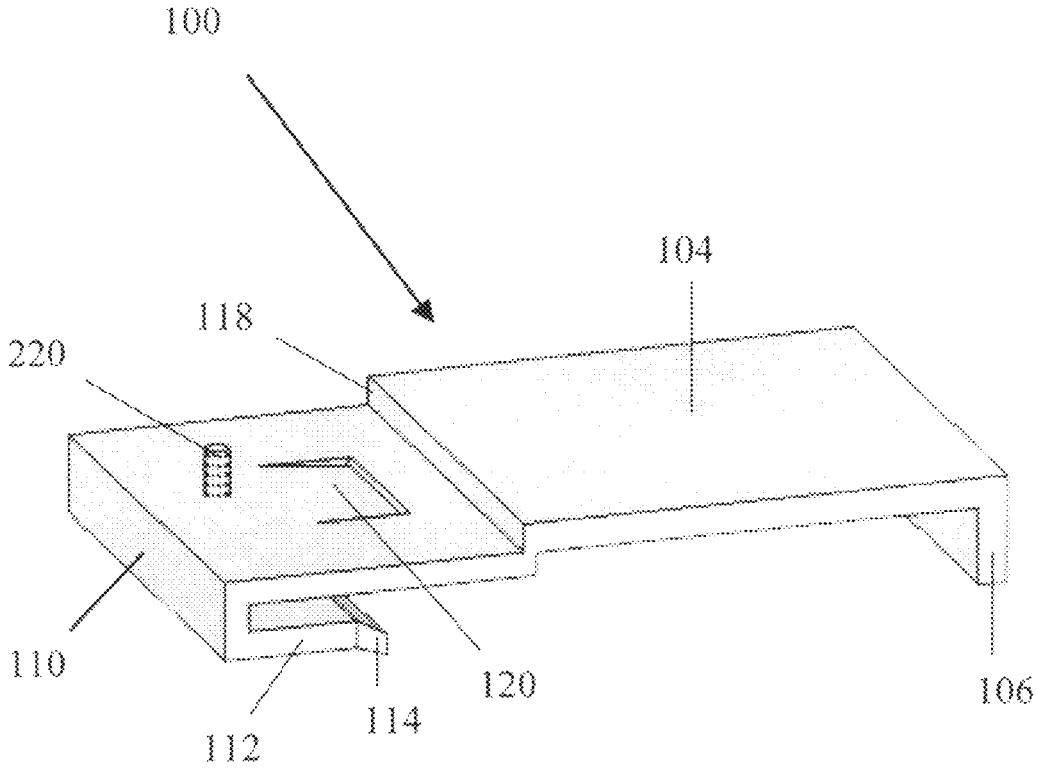
FIG. 3 is a perspective top view of an exemplary spacer according to the present invention.

Turning now to a discussion of the example spacer 100 disclosed according to the present invention, and with best reference to FIGS. 2 and 3, the spacer 100 is preferably provided as a generally rectangular member adapted to be positioned between the joist 202 and the channel 208. The spacer 100 is made from a material, usually steel, that resists and prevents penetration by a conventional wall board fastener such as a nail or a dry wall screw.

FIG. 2 provides an enlarged view of the spacer 100 as installed. As shown, the disposition of the spacer 100 between the joist 202 and the channel 208 provides for the prevention of short circuits. More specifically, the spacer 100 advantageously covers the entire width of the joist 202, the width of the channel 208, and spaces the joist 202 from the channel 208. The spacer material, location and physical separation of these components eliminates the potential for fasteners to extend from the gypsum board 204 into the joist 202, thereby avoiding one of the most common causes of short circuits. As also evident from FIG. 2, the spacer 100 provides a barrier between the joist 202 and the channel 208. This barrier suitably provides a physical impediment that is impervious to a fastener and thereby prevents a fastener to extend from the gypsum board 204 to the joist 202.

Figure 4:
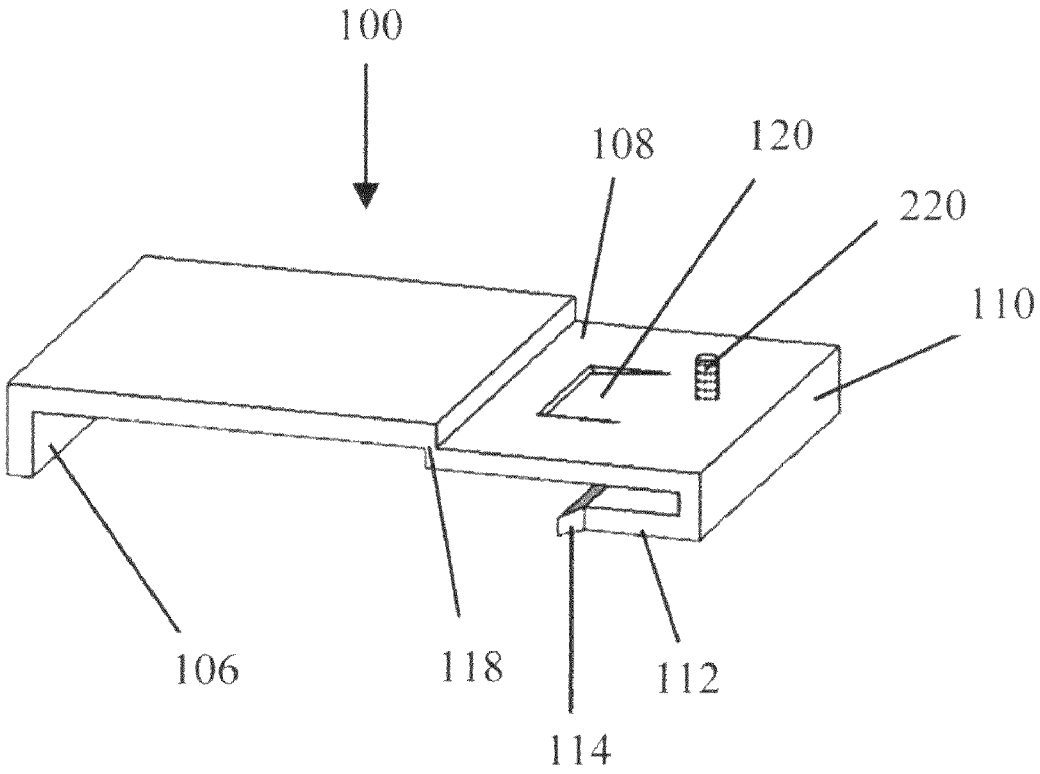
FIG. 4 is a perspective top and side view of the spacer of FIG. 3.
Figure 5:
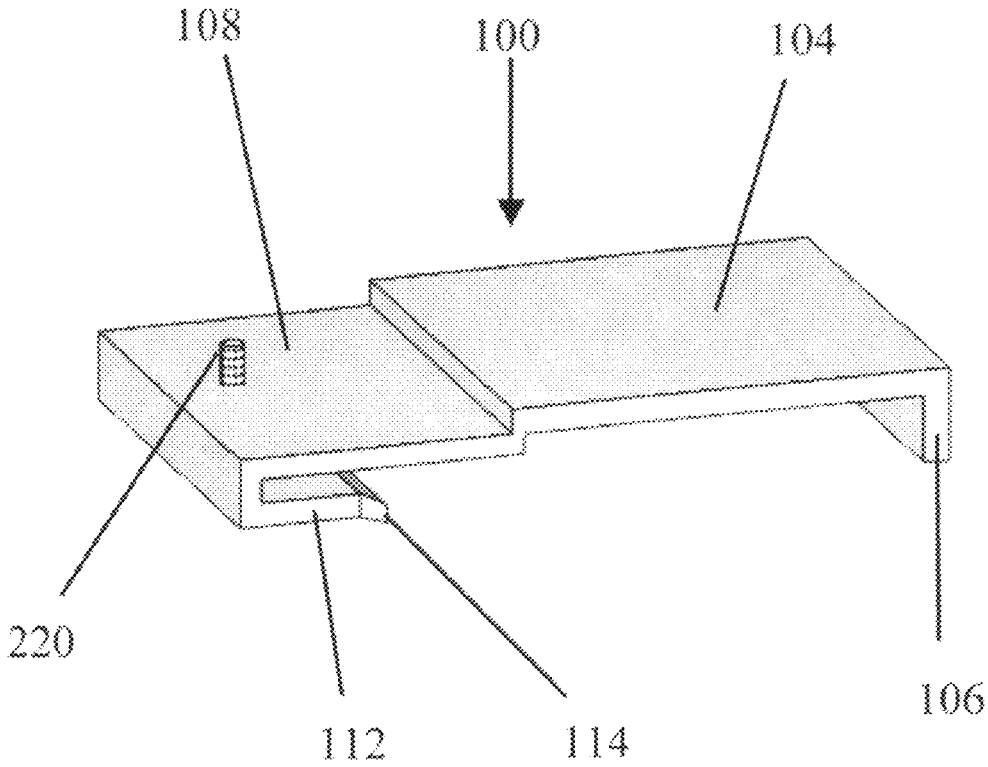
FIG. 5 is a perspective bottom and side view of the spacer of FIGS. 3 and 4.

Turning now to FIGS. 3-5, illustrated is a preferred spacer 100 according to the present invention. The spacer 100 is shown in a preferred embodiment as a generally J-shaped and preferably includes one or more of the following features, a channel interface portion 102, an intermediate portion 108, an extended portion 104, and a flange 106. By way of brief overview, the channel interface portion 102, which is an optional feature, preferably provides a means for associating the spacer 100 and the channel 208 in an assembly, and is preferably configured in a letter "C"-like cross sectional shape. The letter "C" shape defines a pocket-like feature into which a flange 212 of the channel 208 may be received and secured. The intermediate portion 108 generally extends away from the channel interface portion 102 and above a bottom portion thereof. The extended portion 104 preferably extends from an edge of the intermediate portion 108 opposite the channel interface portion 102, and, in a preferred embodiment, is raised relative to the intermediate portion 108. The flange 106 preferably extends from an edge of the extended portion 104 opposite the intermediate portion 108, and preferably at a substantially right angle thereto. Further aspects of these features will be more fully described hereinafter.

With best reference to FIG. 4, the channel interface portion 102 is preferably defined by a corner 110, a lip 112, and a slot 114. The corner 110 is preferably positioned along an end of the spacer 100 and is characterized by the letter "C" configuration. The corner 110 preferably extends from the end of the spacer 100 and continues downward in an arcuate manner, thereby defining an abutment that is generally perpendicular to the spacer 100 and against which the channel 208 flange 212 may be positioned for retention and support.

The corner 110 suitably continues to extend downward away from the spacer 100 arcuately and terminates in the lip 112. The lip 112 is preferably a terminal portion of the channel interface portion 102 that extends generally co-planar with the spacer 100, particularly the extended portion 104 thereof. In this manner, the lip 112 suitably provides a feature that is adapted to underlie the channel 208 flange 212 when disposed in the channel interface portion 102, and suitably also provides a funnel-like effect to facilitate the insertion of the channel 208 flange 212 into the channel interface portion 102. In this regard, the lip 112 may suitably also downwardly flare to increase the funnel-like characteristics of the lip 112.

The channel interface portion 102 suitably also includes the slot 114 into which the channel 208 flange 212 is received. As previously mentioned, the channel interface portion 102 corner 110 suitably extends arcuately from an end of the spacer 100 and curved around into the lip 112. The extension of the corner 110 and lip 112 suitably define the slot 114 that is configured for the channel 208 flange 212.

Turning now to the spacer 100 intermediate portion 108, the intermediate portion 108 is preferably a substantially planar element that extends between the channel interface portion 102 and the extended portion 104. As previously mentioned and as best shown in FIG. 4, the channel interface portion 102 is preferably substantially letter "C"-like in cross sectional shape which together with the extended portion 104 gives the spacer 100 a generally J-shaped overall configuration. The intermediate portion 108 of the spacer 100 preferably extends from an upper terminal portion of the C-shape of the channel interface portion 102. Preferably, the intermediate portion 108 extends along a plane that is vertically reduced relative to the acme of the channel interface portion 102. Because of the arcuate nature of the channel interface portion 102, the terminus of the channel interface portion 102 is disposed at a point vertically reduced relative to its acme; accordingly, the intermediate portion 108 extends at such a reduced vertical position.

The extended portion 104 is preferably a substantially planar member that extends from an edge of the intermediate portion 108 that is opposite the channel interface portion 102. In a preferred configuration, the extended portion 104 is disposed along a plane that is generally parallel to the longitudinal axis of the spacer 100, and extends from the intermediate portion 108 with an initial slight curvature.

The spacer 100 suitably also includes the flange 106. In a preferred embodiment, the flange 106 extends generally perpendicularly from an end of the extended portion 104 that is opposite the intermediate portion 108.

The spacer 100 may suitably include additional features for increasing the grip it exerts on the channel 208. As best shown in FIGS. 3-5, the intermediate portion 108 may suitably include a projection 120 that extends downwardly therefrom toward the channel interface portion 102 lip 112. In this manner, the projection 120 is generally configured to apply pressure to the channel 208 angular arm 216, thereby decreasing the likelihood that the channel 208 may inadvertently come dissociated from the spacer 100.

The spacer 100 may be constructed of any material suitable to the aims of the present invention. In a preferred embodiment, the spacer 100 is constructed of sheet steel, such as a 10 AWG to 24 AWG, 0.050" thick steel sheet that is both structurally sound and impenetrable to a fastener. The use of steel is also advantageous in connection with permitting the spacer 100 to pass a burn test as required by the building construction codes. However, as stated, it is to be appreciated that any suitable material may be employed in the construction of the spacer, such as a polymeric material, a polymeric material featuring a flame-resistant additive, a suitable metal, and the like provided that the necessary penetration resistance is achieved to prevent penetration of fasteners into the joists during installation of the channel.

Despite the foregoing discussion of the structure of the spacer 100, it is to be appreciated that the present invention is not to be construed to the example embodiments discussed and/or illustrated herein. Physically decoupling the channel 208 from the joist 102 is one of the primary objectives and advantages of the present invention, and the spacer 100 may be provided in any suitable configuration capable of achieving this result, such as a substantially planar member adapted to be positioned between the joist 202 and channel 208, a washer-like material so disposed, a rubber material, and the like.

Figure 8:
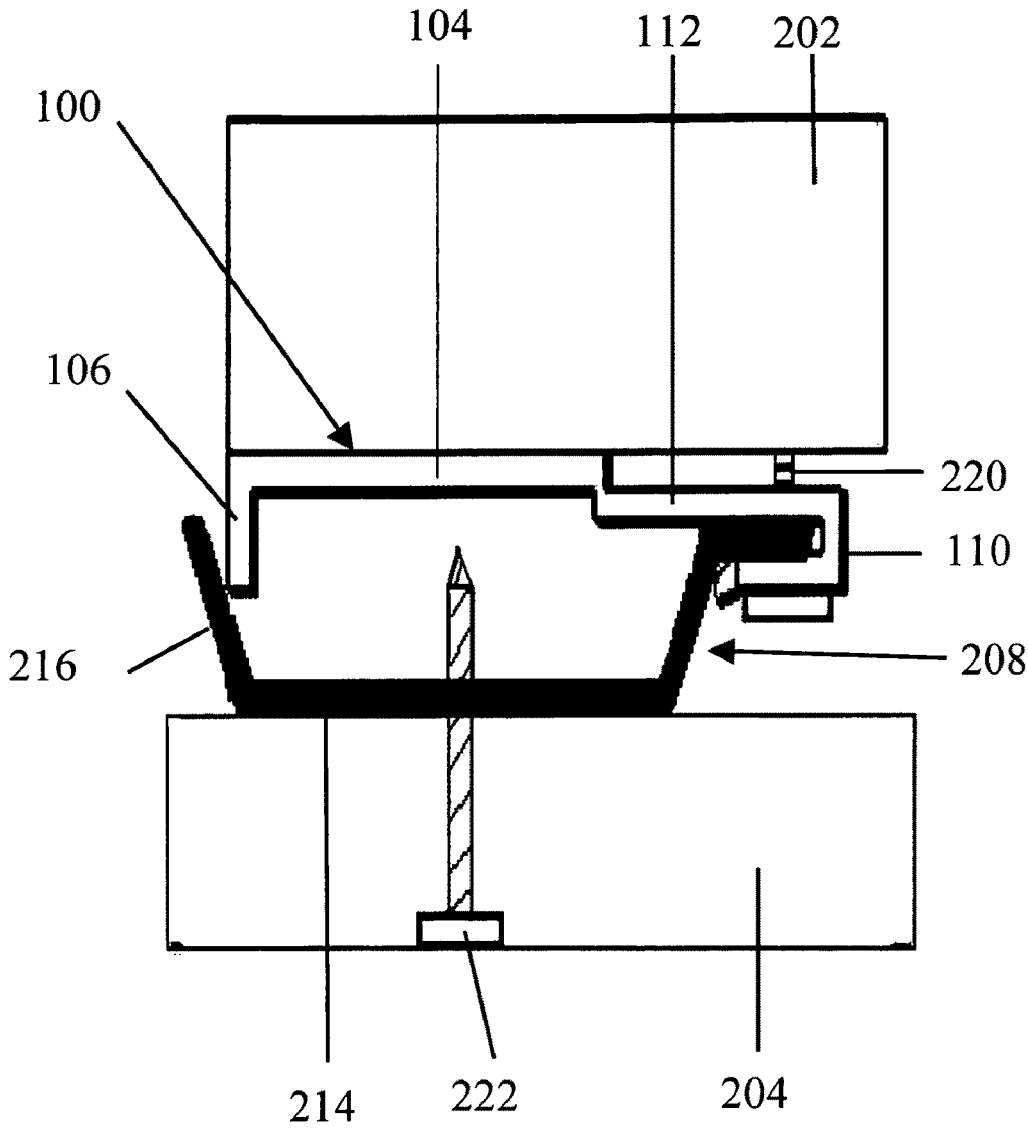
FIG. 8 is a cross sectional view of portions of the building assembly of FIGS. 1 and 2 particularly illustrating the fastening of the spacer to respective flooring assembly components.

A discussion of installation and positioning of the spacer 100 will now be provided in connection with FIGS. 1, 2 and 8. A preferred installation approach begins with the joists 202 installed, and then a spacer 100 and a channel 208 are joined into an assembly. To accomplish this, the channel 208 flange 212 is inserted into the spacer 100 channel interface portion 102. The optional presence of the spacer 100 projection 120 suitably strengthens the connection between the spacer 100 and channel 208. Additionally, the spacer 100 flange 106 is positioned so as to abut the channel 208, preferably near a position where the channel 208 fastening portion 214 and angular arm 216 meet. Thereafter, the joined spacer 100 and channel 208 are brought to the joist 202 and fastened thereto. More specifically, top portions of the spacer 100 are positioned against the joist 202, and the channel 208 is disposed below the spacer 100. The spacer 100 extended portion 104 and upper aspects of the channel interface portion 102 are positioned flush against the joist 202 covering substantially the width of the joist 202 and the width of the channel 208.

Once this preferred configuration is achieved, the assembly of the channel 208 and spacer 100 is fastened to the joist 202. As best shown in FIG. 8, the channel interface portion 102 and/or the intermediate portion 108 include an aperture that permits a fastener 220 to be driven therethrough. Accordingly, the fastener 220 is suitably positioned for penetration of the aperture and driven through the spacer 100 until it securely engages and is anchored in the joist 202. In a preferred embodiment, the spacer 100 aperture is positioned away from the terminal portion of the channel 208 flange 212 so that the fastener 220 does not pass through both the spacer 100 and the channel 208. In this manner, an acoustic short circuit is avoided.

At this point, the channel 208 is prepared to have the gypsum board 204 fastened thereto. Accordingly, the gypsum board 204 is brought flush against the channel 208, and one or more fasteners 222 are driven through the gypsum board 204 and into the channel 208, particularly the fastening portion 214 thereof. It is to be appreciated that the presence of the spacer 100 between the channel 208 and the joist 202 prevents the fastener 222 from extending into the joist 202. First, the extended portion 104 of spacer 100 provides a physical barrier that blocks advance of the fastener 222 and prevents it from extending vertically beyond the spacer 100 and penetrating the joist 202. Second, the spacer 100 also spaces the joist 202 and the channel 208 apart. The increased separation is preferably a distance that the recommended conventional fasteners 222 are incapable of crossing. If the use of improperly long fasteners is attempted, the progress of the fastener will be stopped and the installer will be provided with a visual indication of having used a fastener of an incorrect length.

It is to be appreciated that the presence of the spacer 100 flange 106 provides certain advantages relative to the installation. In one aspect, the presence of the flange 106 ensures proper channel 208 and gypsum board 204 installation. More specifically, the flange 106 suitably prevents the channel 208 angular arm 216 from coming into contact with the joist 202, especially in connection with a resilient channel 208. As the gypsum board 204 is fastened to the channel 208, it applies pressure that tends to bend the channel 208 angular arm 216 upward and into contact with the joist 202. The presence of the spacer 100 flange 106 provides an impediment to the continued bending of the channel 208 angular arm 216 thereby helping to prevent an acoustic short circuit.

Although the invention has been described with regard to certain preferred example embodiments, it is to be understood that the present disclosure has been made by way of example only, and that improvements, changes and modifications in the details of construction and the combination and arrangement of parts may be resorted to without departing from the spirit and scope of the invention. Such improvements, changes and modifications within the skill of the art are intended to be covered by the scope of the appended claims.

What is claimed is:

1. An assembly for preventing an acoustic circuit in a building construction including a structural beam for supporting finished interior components, said assembly comprising:

a spacer; and an elongate U-shaped support operatively associated with said spacer, the elongate U-shaped support defining a lengthwise extending channel and having at least one flange, the U-shaped support extending lengthwise in a direction perpendicular to the length of the structural beam;

wherein the spacer comprises:

a penetration resistant portion having a width that is generally coextensive with the width of the structural beam and a length extending across a substantial portion of the channel defined by said U-shaped support, engagement means supporting said U-shaped support and comprising a C-shaped slot defined by the spacer that receives said flange of the U-shaped support; and a fastener for connecting the spacer and support assembly to the structural beam.

2. The spacer assembly of claim 1, wherein the structural beam is one or more of a horizontal structural beam and a vertical structural beam, and wherein the finished interior component is one or more of an interior finished ceiling element and an interior finished wall element.

3. The spacer assembly of claim 2, wherein the U-shaped support is resilient and adapted for being supported by the spacer and the structural beam and supporting the finished interior element in a spaced relationship to said structural beam.

4. The spacer assembly of claim 2, wherein the spacer further includes a retention means adapted for retaining the U-shaped support in the spacer.

5. The spacer assembly of claim 2, wherein the spacer defines an opening for enabling a fastener to connect the spacer to the structural beam.

6. The spacer assembly of claim 2 wherein the spacer further comprises a fastener blocking means adapted for preventing a fastener from passing therethrough.

7. The spacer assembly of claim 6, wherein the spacer includes a fastener blocking means comprising a substantially planar body disposed perpendicular to the longitudinal axis of a fastener.

8. The spacer assembly of claim 7, wherein said fastener blocking means is adapted to be positioned between the structural beam and the channel defined by the U-shaped support.

9. The spacer assembly of claim 2, wherein the spacer further includes a vertically extending flange adapted to abut a portion of the U-shaped support and resist upward movement of the channel defined by the U-shaped support when a fastener is being driven thereinto.

10. The spacer assembly of claim 2, wherein the structural beam engagement means of the spacer comprises an opening that permits a fastener to be passed therethrough.

11. The spacer assembly of claim 2, wherein the spacer has dimensions for preventing a fastener passing into the channel defined by the U-shaped support from contacting the structural beam.

12. The spacer assembly of claim 2, wherein the spacer is constructed of a flame-retardant material.

13. The spacer assembly of claim 2, wherein the spacer is constructed of steel.

14. A building construction having a flooring or ceiling assembly that displays improved acoustic characteristics, wherein the assembly comprises:

at least one structural beam;

at least one finished interior element;

at least one elongate U-shaped support defining a channel disposed between the finished interior element and the structural beam, the elongate U-shaped support including a flange and extending lengthwise in a direction perpendicular to the length of the structural beam;

at least one fastener extending upward for fastening the finished interior element to the U-shaped support; and a spacer assembly operatively associated with said U-shaped support and disposed at least partially between the support and the finished interior element, and wherein the spacer assembly comprises:

a support engaging means engaging the support and comprising a slot into which the flange of the support is received;

a structural beam engagement means engaging the structural beam, and wherein the spacer is of dimension suitable for preventing a fastener extending upward from the finished interior element from contacting the structural beam; and wherein the structural beam is one or more of a horizontal structural beam and a vertical structural beam, and wherein the finished interior element is one or more of an interior finished ceiling element and an interior finished wall element.

15. The building construction of claim 14, wherein the channel is an elongate resilient support defining a channel and adapted for maintaining a separation between the structural beam and the finished interior element, wherein the finished interior element is gypsum wall board, and wherein the structural beam is constructed of one of lumber or metal framing.

16. The building construction of claim 14, wherein the support engaging means further comprises a retention means adapted for retaining the channel in association with the spacer.

17. The building construction of claim 14, wherein the spacer further comprises a fastener blocking means adapted for preventing a fastener from passing therethrough.

18. The building construction of claim 17, wherein the spacer fastener blocking means comprises a substantially planar body disposed perpendicular to the longitudinal axis of the fastener.

19. The building construction of claim 18, wherein the fastener blocking means is positioned between the structural beam and the channel defined by the U-shaped support.

20. The building construction of claim 14, wherein the spacer further comprises a vertically extending flange abutting a portion of the U-shaped support and adapted to resist upward movement of the support when a fastener is driven thereinto.

21. The building construction of claim 14, wherein the structural beam engagement means comprises an opening, and wherein a fastener extends through the structural beam engagement means and into the structural beam, thereby fastening the spacer to the structural beam.

22. The building construction of claim 14, wherein the spacer is constructed of a flame-retardant material.

23. The building construction of claim 14, wherein the spacer is constructed of steel.

* * * * *